US007146876B2

(12) United States Patent
Willemsen et al.

(10) Patent No.: US 7,146,876 B2
(45) Date of Patent: Dec. 12, 2006

(54) ADJUSTABLE PEDAL ASSEMBLY

(75) Inventors: Larry G Willemsen, Morpeth (CA); Dan O'Neill, Chatham (CA); Mike Olajos, Ridgetown (CA); Rob Soteros, LaSalle (CA)

(73) Assignee: KSR International Company, Ridgetown (CA)

( * ) Notice: Subject to any disclaimer, the term of this patent is extended or adjusted under 35 U.S.C. 154(b) by 434 days.

(21) Appl. No.: 10/608,484

(22) Filed: Jun. 27, 2003

(65) Prior Publication Data

US 2004/0000211 A1 Jan. 1, 2004

Related U.S. Application Data

(60) Provisional application No. 60/392,325, filed on Jun. 28, 2002.

(51) Int. Cl.
*G05G 1/14* (2006.01)

(52) U.S. Cl. ..... 74/512; 74/560

(58) Field of Classification Search ..... 74/512, 74/513, 514, 560, 564; *G05G 1/14*
See application file for complete search history.

(56) References Cited

U.S. PATENT DOCUMENTS

| | | | | |
|---|---|---|---|---|
| 3,151,499 | A * | 10/1964 | Roe | 74/560 |
| 4,779,481 | A | 10/1988 | Natzke et al. | 74/512 |
| 4,989,474 | A | 2/1991 | Cicotte et al. | 74/512 |
| 5,771,752 | A | 6/1998 | Cicotte | 74/512 |
| 6,073,515 | A * | 6/2000 | Elton et al. | 74/564 |
| 6,151,984 | A | 11/2000 | Johansson et al. | 74/512 |
| 6,151,986 | A | 11/2000 | Willemsen et al. | 74/512 |
| 6,178,847 | B1 | 1/2001 | Willemsen et al. | 74/512 |

(Continued)

FOREIGN PATENT DOCUMENTS

| | | | |
|---|---|---|---|
| EP | 0 918 273 A1 | 5/1999 | 1/14 |

(Continued)

OTHER PUBLICATIONS

Pontiac GM, 1974 Pontiac Service Manual.

*Primary Examiner*—Vinh T. Luong
(74) *Attorney, Agent, or Firm*—Gifford, Krass, Groh, Sprinkle, Anderson & Citkowski, P.C.

(57) ABSTRACT

An adjustable pedal assembly for a vehicle includes a mounting bracket having a mounting face and a pair of opposed upper arms. The assembly includes a first lever arm supported between the pair of mounting bracket upper arms at a first fixed pivot point. The assembly also includes a swing plate pivotally supported by the first lever arm at a second non-fixed pivot point located radially outboard from the first fixed pivot point, and having a mounting face, a pair of upper arms radially extending, a vertically extending lower arm and an outwardly extending pedal support arm. The assembly further includes a second lever arm pivotally attached to the swing plate lower arm at a third non-fixed pivot point at one end and another end pivotally attached to the mounting bracket at a fourth fixed pivot point. The assembly includes a pedal arm operatively attached to the swing plate with a pedal pad attached at a lower end. The assembly further includes an adjustment means connected to the pedal support arm for adjusting the position of the pedal pad by pivoting the first lever arm about the first fixed pivot axis, pivoting the swing plate about the second non-fixed pivot point, pivoting the swing plate lower arm about the second fixed pivot axis, pivoting the second lever arm about the third non-fixed pivot point and the fourth fixed pivot point, to constrain the travel of pedal pad along a predetermined path.

25 Claims, 6 Drawing Sheets

U.S. PATENT DOCUMENTS

| | | | | |
|---|---|---|---|---|
| 6,305,239 | B1 | 10/2001 | Johansson et al. | 74/512 |
| 6,374,695 | B1 | 4/2002 | Johansson et al. | 74/512 |
| 6,389,927 | B1 | 5/2002 | Willemsen | 74/512 |
| 6,453,767 | B1 | 9/2002 | Willemsen et al. | 74/512 |
| 6,520,045 | B1 * | 2/2003 | Fukase et al. | 74/512 |
| 6,584,871 | B1 | 7/2003 | Burton et al. | 74/512 |
| 6,722,226 | B1 * | 4/2004 | Neag et al. | 74/512 |
| 6,763,741 | B1 * | 7/2004 | Frobel et al. | 74/512 |
| 2002/0038577 | A1 * | 4/2002 | Bialk et al. | 74/512 |
| 2002/0088303 | A1 * | 7/2002 | Hayashihara et al. | 74/560 |
| 2002/0092374 | A1 | 7/2002 | Johansson et al. | 74/512 |

FOREIGN PATENT DOCUMENTS

| | | | | |
|---|---|---|---|---|
| FR | 2 715 485 | * | 7/1995 | |
| JP | 61-11836 | * | 1/1986 | |
| JP | 2002-287837 | * | 10/2002 | |
| SE | 518 099 | | 8/2002 | 1/14 |
| WO | WO 2004/050445 A1 | * | 6/2004 | |

* cited by examiner

ADJUSTABLE PEDAL ASSEMBLY

RELATED INVENTION

This application claims priority of U.S. Provisional Patent Application 60/392,325 filed Jun. 28, 2002, entitled "Pedal Adjuster With Swing Plate" and is incorporated herein by reference.

FIELD OF INVENTION

This invention relates to pedals, and more particularly to an adjustable pedal assembly for a vehicle.

BACKGROUND OF THE INVENTION

Vehicles, such as motor vehicles, typically contain foot-actuated devices or pedals for controlling various functions of the vehicle. These functions are known to include: acceleration, controlled by an accelerator pedal; braking, controlled by a brake pedal; and shifting, controlled by a clutch pedal. In addition, the vehicle may include a non-functional pedal that serves as a footrest for the driver. The pedals are aligned in a predetermined dimensional relationship relative to each other and fixed portions of the vehicle, including the vehicle dash panel, floor, seat and instrument panel. The pedal pad portion of the pedal assembly travels in a predetermined path. In the past, the path was typically an arc. Thus, to move the pedal pad closer to the driver, the pedal pad typically moves along the path into the vehicle, closer to the driver. The pedal pad is moved away from the driver by moving the pedal pad along the path away from the driver.

The pedals are positioned in the vehicle so that they are accessible by the driver. However, drivers come in a wide variety of shapes and sizes, and a pedal positioned to accommodate a large driver with a large foot will generally be unreachable by a small driver with a small foot. In the past, the pedals were fixedly positioned so that the majority of drivers were accommodated, from a functional and ergonomic aspect. An example of a functional aspect of the pedal is the ability of the driver to reach and actuate the pedal. An example of an ergonomic aspect of the pedal is the driver's comfort while actuating the pedal, as measured by a parameter such as foot angle.

More recently, adjustable pedals have been used in vehicles to accommodate a greater number of drivers from a functional and ergonomic perspective. With an adjustable pedal, the driver can modify the position of the pedal so that it is either closer to the driver or away from the driver. However, moving the pedal closer to the driver raises the height of the pedal pad with respect to the floor of the vehicle. As a result, the driver's heel may not rest on the floor of the vehicle. One consequence of not resting the driver's foot on the floor is the potential for foot fatigue during driving. In the past, the length of the accelerator pedal pad was increased to overcome this concern. However, there are limitations as to how much the pedal pad can increase in length. At the same time, it is essential that the relative dimensional relationships between the pedals are maintained during adjustment, such as the height relationship between each of the pedals.

An example of such an adjustable pedal is disclosed in commonly assigned U.S. Pat. No. 6,151,986 to KSR International, Inc. entitled "Adjustable Vehicle Control Pedals," the disclosure of which is incorporated herein by reference. This type of adjustable pedal works well, and includes an adjustment mechanism comprising a motor, a drive mechanism operatively connected to the motor and a screw mechanism operatively connected to the pedal.

Another example of an adjustable control vehicle pedal is disclosed in U.S. Pat. No. 6,389,927. The patent discloses a control pedal arrangement including a base member having an integral support arm for supporting a pedal arm. The base also has a guide device and control mechanism for adjusting the position of the pedal arm. The control mechanism includes a motor with a gear for driving a screw rod. The screw rod extends between the base and the pedal arm and pivotally adjusts the position of the pedal arm with respect to the operator. In operation, as the pedal arm is pivoted about a pivot axis, the pedal pad moves through an arc which raises the pedal pad as it moves into the vehicle. At the same time the pedal pad is angled upwardly. While this adjustment method works, the modified angle of the pedal pad may not be ergonomically desirable.

Thus, there is a need in the art for an ergonomically beneficial adjustable pedal assembly that controls the rise, run and angle of the pedal pad with respect to the driver during adjustment of the pedal assembly.

SUMMARY OF THE INVENTION

Accordingly, the present invention is an adjustable pedal assembly. The adjustable pedal assembly includes a mounting bracket having a mounting face and a pair of opposed upper arms. The assembly includes a first lever arm supported between the pair of mounting bracket upper arms at a first fixed pivot point. The assembly also includes a swing plate pivotally supported by the first lever arm at a second non-fixed pivot point located radially outboard from the first fixed pivot point, and having a mounting face, a pair of upper arms radially extending, a vertically extending lower arm and an outwardly extending pedal support arm. The assembly further includes a second lever arm pivotally attached to the swing plate lower arm at a third non-fixed pivot point at one end and another end pivotally attached to the mounting bracket at a fourth fixed pivot point. The assembly includes a pedal arm operatively attached to the swing plate with a pedal pad attached at a lower end. The assembly further includes an adjustment means connected to the pedal support arm for adjusting the position of the pedal pad by pivoting the first lever arm about the first fixed pivot axis, pivoting the swing plate about the second non-fixed pivot point, pivoting the swing plate lower arm about the second fixed pivot axis, pivoting the second lever arm about the third non-fixed pivot point and the fourth fixed pivot point, to constrain the travel of the pedal pad travels along a predetermined path.

One advantage of the present invention is that an adjustable pedal assembly is provided with a pedal pad that can be ergonomically positioned to accommodate a variety of drivers while retaining the functional features of the pedal assembly. Another advantage of the present invention is that an adjustable pedal assembly is provided whereby the rise and angle of the pedal pad is constrained as the pedal position is adjusted closer to or farther away from the driver. A further advantage of the present invention is that an adjustable pedal assembly is provided that allows the driver to maintain their heel on the floor of the vehicle while actuating the pedal, in all pedal adjustment positions. Still a further advantage of the present invention is that the motion of the pedal pad is linear during adjustment of the pedal position.

Other features and advantages of the present invention will be readily understood as the same becomes better understood after reading the subsequent description when considered in connection with the accompanying drawings.

DESCRIPTION OF THE PREFERRED EMBODIMENTS

Figure 1:
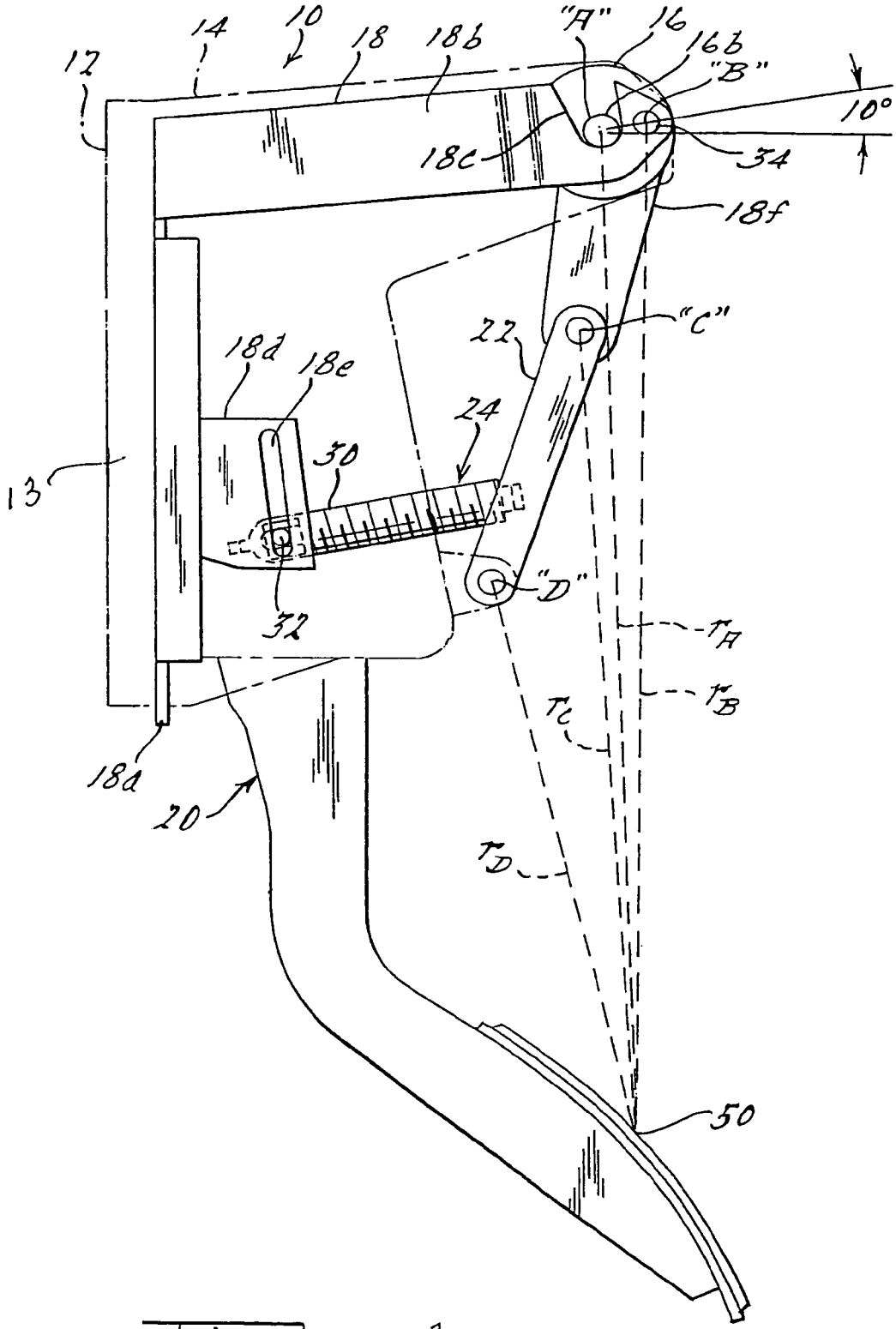
FIG. 1 is a side elevational view of an adjustable pedal assembly in a non-adjusted position, according to the present invention.
Figure 2:
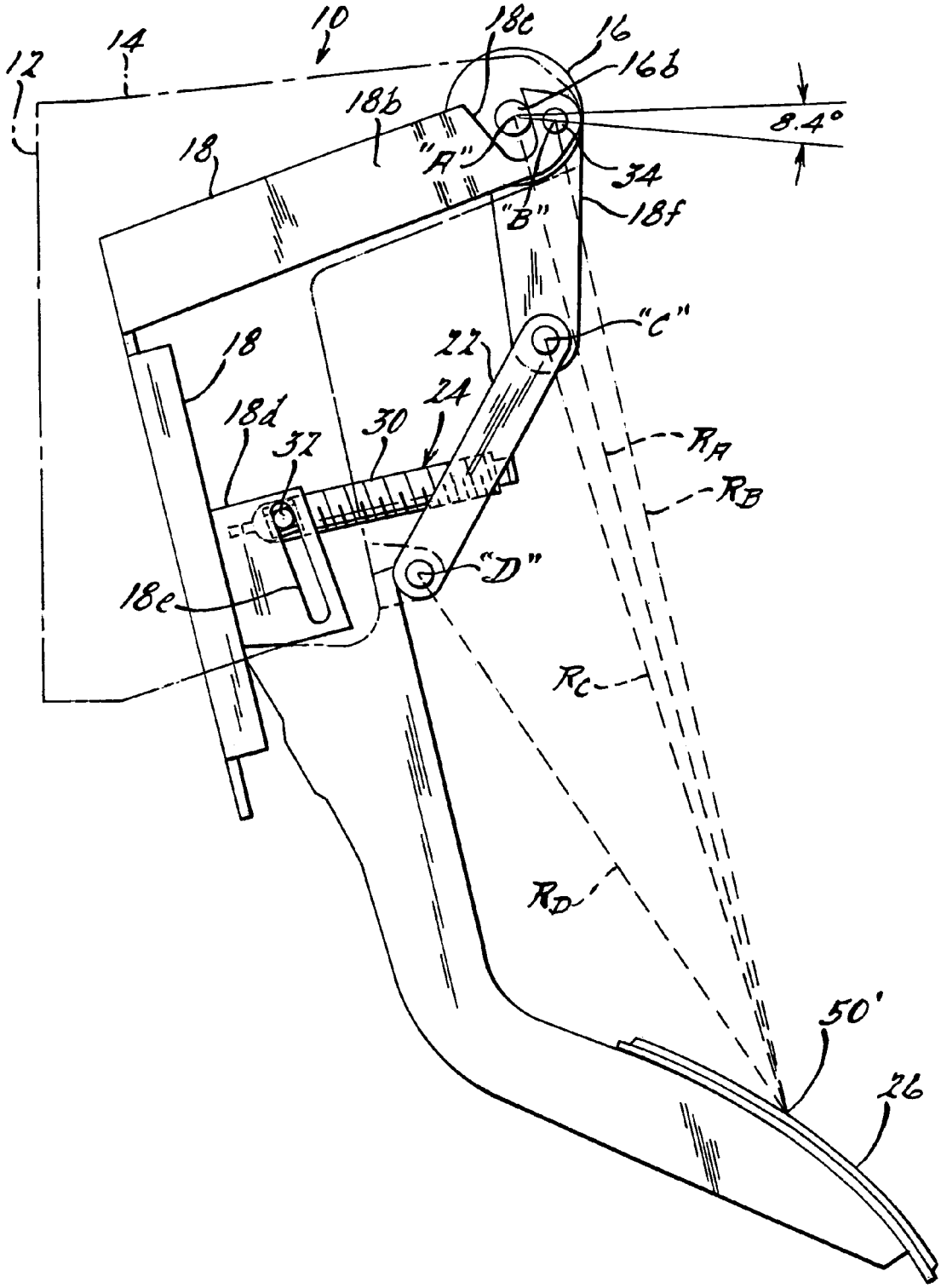
FIG. 2 is a side elevational view of the adjustable pedal assembly of FIG. 1 in an adjusted position, according to the present invention.
Figure 3:
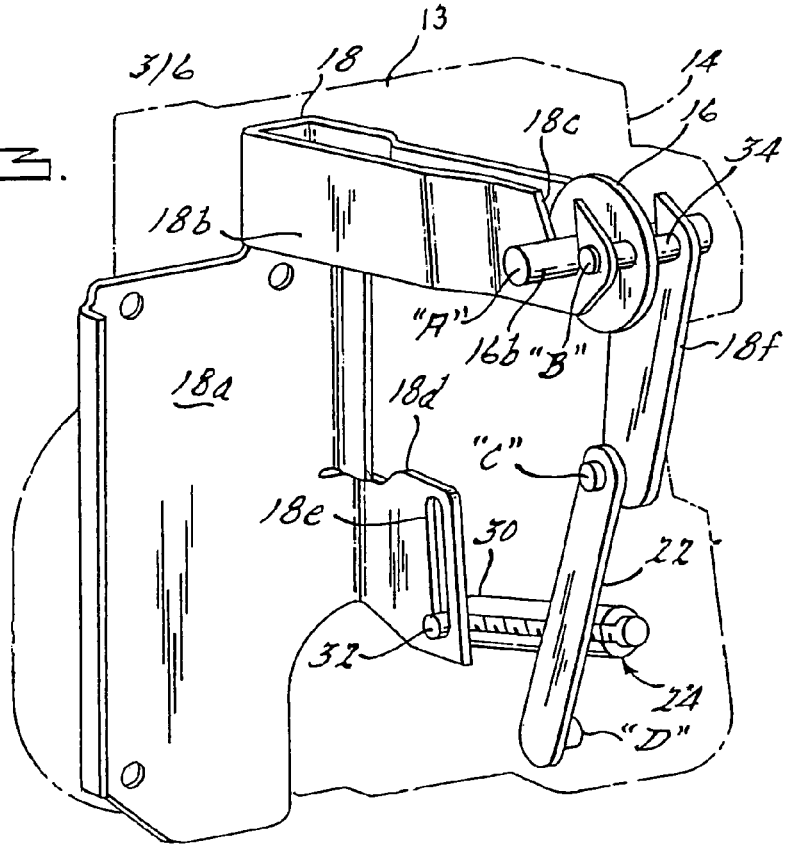
FIG. 3 is a perspective front view of the swing plate of FIG. 1, according to the present invention.
Figure 4:
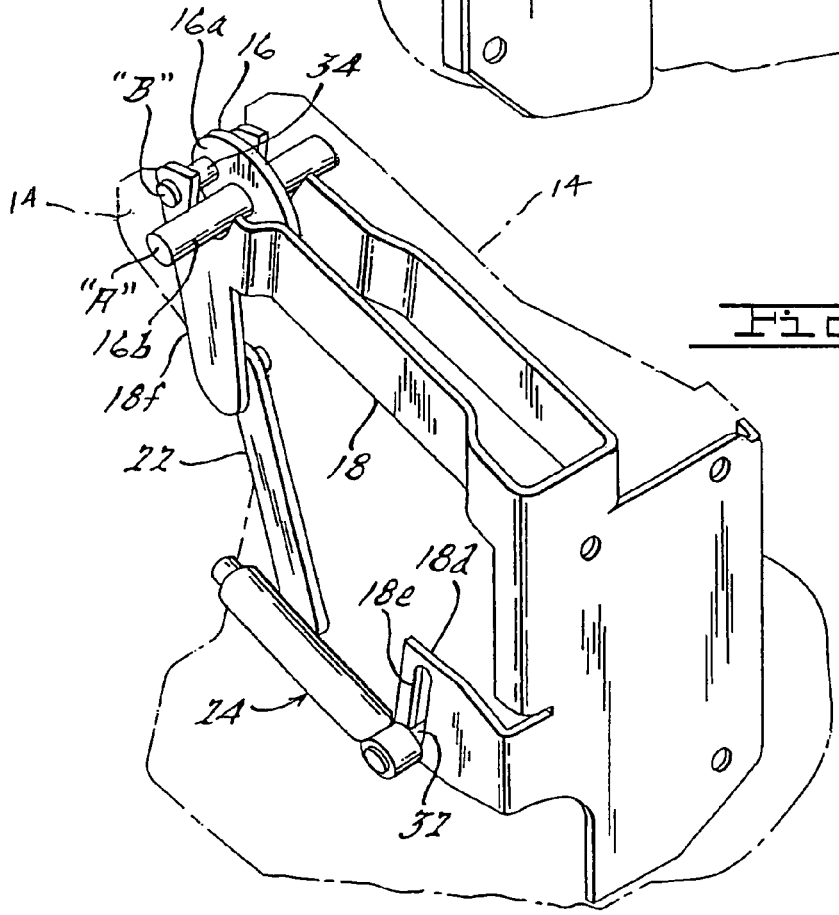
FIG. 4 is a perspective rear view of the swing plate of FIG. 1, according to the present invention.

Referring to FIGS. 1–4, an adjustable pedal assembly 10 for transferring a signal between a vehicle operator or driver (not shown) and an actuating mechanism (not shown), for controlling the movement of the vehicle, is illustrated. In FIG. 1, the pedal assembly 10 is shown in a non-adjusted position, whereas in FIG. 2 the pedal assembly 10 is shown in an adjusted position. The pedal assembly 10 includes a mounting bracket 12, or mounting base for attaching the pedal assembly 10 to a portion of the vehicle. In this example, the mounting bracket is attached to the dash panel. The mounting bracket includes a generally planar mounting face. The mounting face includes at least one aperture (not shown) for attaching the mounting bracket to the vehicle using an attaching means (not shown), such as by bolting or the like.

The mounting bracket 12 also includes a pair of upper arms 14 extending radially from an upper end of the mounting face 13, such that the arms oppose each other. The mounting bracket upper arms 14 pivotally support a lever arm extending therebetween the arms, in a manner to be described. The mounting bracket 12 has a generally inverted "L" shape.

The pedal assembly 10 also includes a first lever arm 16 disposed between the mounting bracket upper arms 14. In this example, the first lever arm includes a disc-shaped member 16*a*, although other shapes are contemplated. The first lever arm 16 also includes a pivot pin 16*b* for pivotally supporting the first lever arm 16 between the mounting bracket upper arms 14 at a first fixed pivot point. In this example, the first fixed pivot point pivots about an axis labeled "A".

The pedal assembly 10 also includes a swing plate 18 that is pivotally supported by the first lever arm 16 at a second non-fixed second pivot point which is located radially outward from the fixed first pivot point "A". The second non-fixed pivot point pivots about an axis labeled "B". The swing plate 18 is attached to the first lever arm 16 at the second non-fixed pivot point "B" using a conventionally known attaching means, such as pin and clip or the like.

The swing plate includes a generally planar mounting face 18*a*, and a pair of arms 18*b* extending radially from an upper edge of the swing plate mounting face 18*a*. The swing plate 18 is pivotally attached to the first lever arm 16 at the second non-fixed attachment point "B", which is located at an outer end of the arm 18*b*. It should be appreciated that in this example the second pivot axis "B" is positioned radially outward from the first pivot axis "A" of the first lever arm, and about 10 degrees above a horizontal line through point "A" in a non-adjusted position, and about 8.4 degrees below the horizontal line shown at an adjusted position. In addition, the upper arm 18*b* may include a notched portion for clearance purposes as shown at 18*c*. The swing plate 18 further includes a lower arm 18*f* extending radially from an edge of one of the upper arms that is substantially vertically oriented. The function of the lower arm 18*f* will be described in detail below.

The swing plate 18 also includes a pedal support arm 18*d* extending radially from an outer edge of the mounting face 18*a*. The pedal support arm 18*d* includes a slot 18*e* having a generally vertical orientation for a purpose to be described. It should be appreciated that the pedal support arm 18*d*, mounting face 18*a*, upper arm 18*b* and lower arm 18*f* are integral and formed as one using a rigid material such as steel or plastic or the like.

The pedal assembly 10 further includes a second lever arm 22. Preferably, the second lever arm 22 is a generally planar member. An upper end of the second lever arm 22 is pivotally attached to the swing plate lower arm 18*f* at a third, non-fixed, pivot point as shown at "C". In this example, the angular relationship between the swing plate lower arm 18*f* and the second adjustment lever arm 22 is about 166.7 degrees in a non-adjusted pedal position, and 142.9 degrees in a fully adjusted position. A lower end of the second lever arm 22 is pivotally attached to the mounting bracket 12 at a fourth, fixed, pivot point, as shown at "D".

Preferably, the swing plate mounting face 18*a* provides a support surface for a conventional pedal arm 20. In this example, the pedal arm is an elongated member having a front face portion, and side portions extending from an edge of the face portion. An upper end of the pedal arm includes an aperture for securing the pedal arm 20 to the swing plate mounting face, such as by bolting or the like. A pedal pad 26 is secured to a lower end of the pedal arm. In this example, the pedal pad is a rectangular member made from an isomeric material, such as rubber. The pedal arm 20 is fixedly attached to the swing plate 18. This allows for integral movement of the swing plate 18 and pedal arm 20 about the pedal arm pivot axis "B".

Also in this example, the pedal assembly 10 is an electronically controlled throttle assembly, as is known in the art, and includes an electronic position sensing device. An example of an electronic sensing device is a position sensor, potentiometer, inductive sensor, hall sensor or the like.

Movement of the pedal arm relative to the pedal arm pivot point produces an electronic control signal proportional to the position of the pedal arm, to operate the corresponding control, such as the brake, transmission or engine control.

The pedal assembly 10 further includes an adjustment mechanism 24 for adjusting the position of the pedal pad 26. The adjustment mechanism 24 includes a drive motor (not shown) preferably mounted to the mounting bracket 12 to adjust the position of the swing plate 18 and pedal arm 28. The adjustment mechanism 24 also includes a screw rod 30, wherein one end of the screw rod 30 is operatively attached to the drive motor, and the other end of the screw rod 30 is operatively attached to the swing plate 18. In this example, the screw rod 30 includes a radially extending pin 32 that is slidingly disposed in a guide slot 18*e* in the swing plate pedal support arm 18*d*. The drive unit has a drive shaft with a worm gear portion, which engages a gear wheel with a threaded aperture to move the screw rod 30. The drive motor is preferably connected to the drive shaft by a cable to drive the shaft.

In operation, activation of the motor worm gear rotates the screw rod 30 to move the lower end of the swing plate 18 and the pedal arm 20 in a predetermined direction, such as forwardly or rearwardly, depending upon the direction of rotation of the screw rod 30. In a non-adjusted position as shown in FIG. 1, the screw rod 30 is located at the bottom of the guide slot 18*e*. As the lower end of the swing plate 18 is pulled by movement of the screw rod, the pin 32 slides through the guide slot 18*e*. It should be appreciated that the shape and position of the guide slot 18*e* defines the travel of the swing plate 18.

Concurrently, the upper end of the swing plate 18 begins to rotate about the mounting axis "B" at the second pivot point, while the first lever arm 16 pivots about the fixed pivot point at axis "A", so that the upper arm 18*b* of the swing plate and fixed support arm 18*f* moves downwardly and forwardly as the bottom of the swing plate moves rearwardly into the vehicle. It should be appreciated that the pivot point "B" is initially oriented about 10 degrees above a horizontal line through the pivot point prior to adjustment, and about 8 degrees below the horizontal line after adjustment. In addition, as the swing plate 18 rotates about the second non-fixed pivot point "B", the second lever arm 22 begins to rotate about the third, non-fixed pivot point "C", and the fourth fixed pivot point "D". It should be appreciated that an angle formed between the swing plate and adjustment lever decreases as the pedal pad portion is adjusted. As the swing plate 18 and first lever arm 16 rotate, the pivot link rotates about the first, fixed pivot link point "A".

Advantageously, the position of the pedal pad moves along a predetermined path towards the driver, while a predetermined vertical height between the floor and a point on the pedal pad is maintained. Similarly, an angular relationship between the pedal pad and the floor of the vehicle is maintained as the pedal pad moves closer to the driver. It should be appreciated that the non-fixed pivot points "B" and "C" constrain the motion of the swing plate 18, to maintain the predetermined distance between the pedal pad 26 and the floor of the vehicle.

For example, a radius may be drawn between a fixed point on the pedal pad 50 and each of the pivot points "A", "B", "C" and "D" for the pedal in the non-adjusted position. These radiuses are labeled $r_A$, $r_B$, $r_C$ and $r_D$ respectively. A similar radius may be drawn between a corresponding point on the pedal pad 50' and each of the pivot points "A", "B", "C" and "D" for the pedal in the fully adjusted position. These radiuses are labeled $R_A$, $R_B$, $R_C$ and $R_D$ respectively. The ratios $$\frac{r_A}{R_A}, \frac{r_B}{R_B}, \frac{r_c}{R_C} \text{ and } \frac{r_D}{R_D}$$

may be computed. For the fixed pivot points "A" and "D", the ratios $$\frac{r_A}{R_A} \text{ and } \frac{r_D}{R_D}$$

vary throughout the adjustment motion. For the non-fixed pivot points "B" and "C", the ratios $$\frac{r_B}{R_B} \text{ and } \frac{r_c}{R_C}$$

are 1, indicating that the radius stays the same throughout the adjustment motion. This unique combination of fixed and non-fixed pivot points constrains the motion of the pedal pad along the predetermined linear path. This is distinguishable from the motion of the pedal pad along a radial path using one pivot point, as described by the prior art.

Thus, the non-fixed pivot points constrain the movement of the pedal pad, so that the pedal pad does not follow the radial curve through the first pivot point, but retains the substantially same relationship between the pedal pad and the floor of the vehicle. The addition of the movable pivot points causes the pedal pad position to move towards the driver during adjustment without rising off the floor. The orientation of the pedal pad is also substantially the same after adjustment as before adjustment.

Figure 5A:
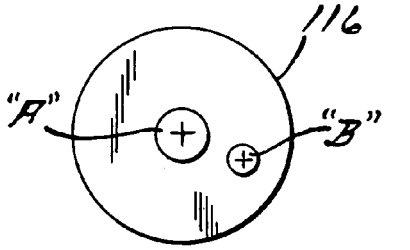
FIGS. 5A–5C are elevational views of alternative embodiments for the lever arm attachments, according to the present invention.
Figure 5B:
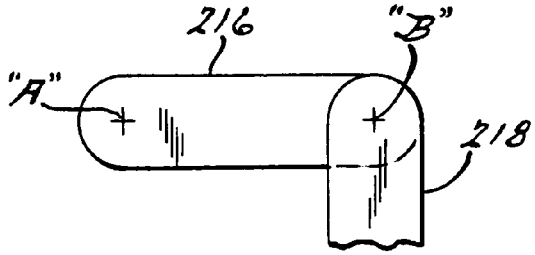
Figure 5C:
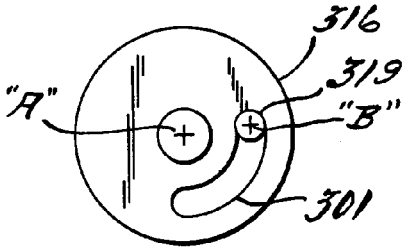

As shown in FIGS. 5A–5C, several alternative embodiments of the first lever arm 16 are illustrated. It should be appreciated that the linear motion of the pedal pad 26 for each of these embodiments during adjustment is the same as previously described.

For example, in FIG. 5A, like features have similar reference numbers increased by 100. Thus, the first lever arm 116 is a disc-shaped member and the first lever arm 116 is attached to the mounting bracket at fixed pivot point "A". The swing plate is pivotally attached to the first lever arm 116 at pivot point "B". The pivot point "B" is positioned radially outward and below a horizontal line drawn through pivot point "A". The operation of the pedal assembly is similar to that described with respect to FIGS. 1–4.

In FIG. 5B, like features have similar reference numbers increased by 200. In this embodiment, the first lever arm 216 is a planar member that is generally rectangular in shape. One end of the lever arm is pivotally mounted to the mounting bracket 12 at a fixed pivot point shown at A". The opposite end of the first lever arm 216 is pivotally connected to the swing plate 216 at a non-fixed pivot point shown at B". The operation of the pedal assembly is similar to that described with respect to FIGS. 1 and 2.

In FIG. 5C, like features have similar reference numbers increased by 300. In this embodiment, the first lever arm 316 is a disc-shaped member having an arcuate slot 301 disposed radially outwardly from the center of the lever arm 316. The first lever arm 316 is pivotally mounted to the mounting bracket at a fixed pivot point labeled A'''. The swing plate is slidably attached to the first lever arm 316 at a non-fixed pivot point labeled "B". For example, the swing plate 318 includes a radially oriented pin 319 that is received in the arcuate slot 301 in the first lever arm 316, and the pin 319 travels within the arcuate slot 301 as the pedal position is adjusted. The operation of the pedal assembly is similar to that described with respect to FIGS. 1 and 2.

Figure 7:
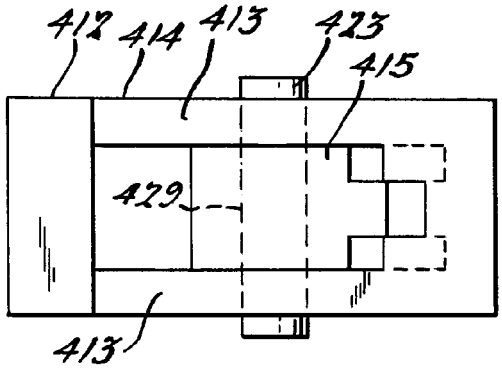
FIG. 7 is a top view of the adjustable pedal assembly of FIG. 6, according to the present invention.
Figure 6:
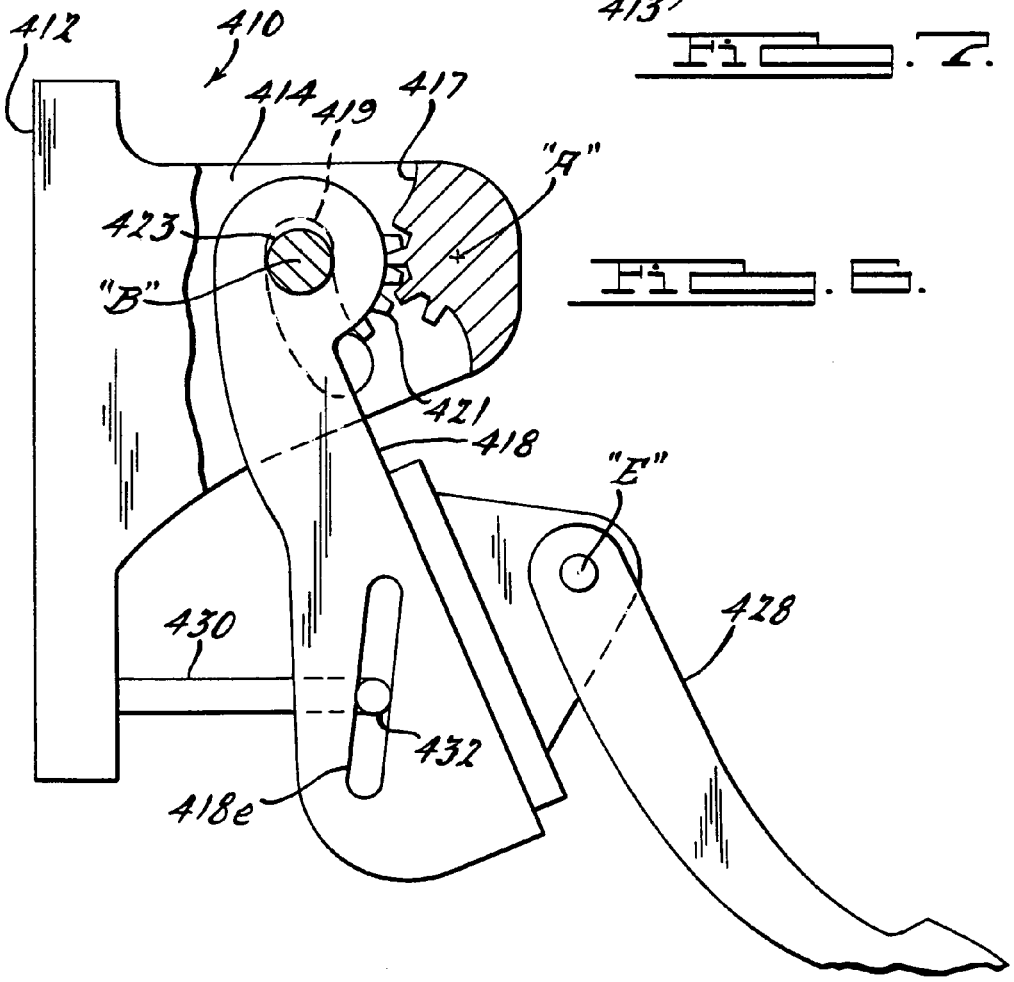
FIG. 6 is a side elevational view of another embodiment of an adjustable pedal assembly, according to the present invention.

Referring to FIGS. 6 and 7, an alternative embodiment of an adjustable pedal assembly is illustrated. It should be appreciated that like parts to the pedal assembly described with respect to FIGS. 1–4 have like reference numbers increased by 400. It should be appreciated that the adjustable pedal assembly 410 may be an electronically controlled throttle assembly, as is known in the art, and include an electronic position sensing device. The adjustable pedal assembly 410 includes a mounting bracket 412 having a generally planar face for securing the mounting bracket to the vehicle. The mounting bracket includes an upper arm 414 extending radially from an upper end of the mounting face that forms a guide housing. Preferably, the mounting bracket 412 has an "L" shape.

The upper arm 414 includes a cut-away portion 415 to accommodate the motion of the swing plate 418, as shown in FIG. 7. In this example, the cut-away portion 415 is part of a guide housing having a rectangular opening for receiving the top portion of a swing plate 418. The rectangular opening 415 is defined by the opposed side walls 413 of the upper arm 414 and a rear surface of the mounting bracket 412. A gear sector 417 is formed in an end of the upper arm 414 and has a pivot point "A" which is positioned inwards of the gear teeth. An example of a type of gear sector is a spur gear. Each side wall 413 of the upper arm 414 includes an arcuate slot 419. In this example, the arcuate slot 419 has a radius of curvature centered on a pivot point "A". The swing plate 418 is slidingly supported within the arcuate slot 419. An upper end of the swing plate 418 has an integrally formed gear sector 421 having a tooth shape, that operatively cooperates with the gear sector 417 formed by the mounting bracket upper arm 414.

The swing plate 418 is pivotally attached to the mounting bracket 412 via a sector pin 423 that extends through the slots 419 of the guide housing and a throughbore 429 in the top of the swing plate, so that the swing plate 418 pivots at a non-fixed attachment pivot point "B". The throughbore is coaxial with the center of curvature of the gear sector 421.

The pedal assembly also has a pedal arm 428 pivotally attached to the swing plate at a pivot point "E". It should be appreciated that an electronic position sensing device, not shown but known in the art, may be located at pivot point "E" for sensing the angular pedal arm rotation about pivot point "E". The pedal assembly further includes an adjustment mechanism as previously described. A lower portion of the swing plate 418 has a slot 418*e* to receive a pin 432 attached at the end of a screw rod 430, as previously described. The slot 418*e* is angled slightly from a vertical line. In operation, the screw rod 430 is driven by the motor, as previously discussed, and the pin 432 rides within the slot 418*e* in the swing plate 418. As the screw rod 430 is moved outwardly from the mounting bracket 412, the sector pin 423 is guided through an arcuate path formed by the slot 419 in the guide housing of the upper arm 414 to keep the gear sectors 421, 417 in mesh as the swing plate 418 is pivoted about the point "B" within the slot 419 in the upper arm 414. Thus, the upper end of the swing plate 418 moves downwardly and rearwardly through the path formed by the slot 419 in the guide housing upper arm 414.

As the lower portion of the swing plate 418 moves outwardly, the bottom portion of the swing plate 418 is guided by the pin 432 at the end of the screw rod 430 to move outwardly and somewhat downwardly as the screw rod 430 is extended. Advantageously, in this example the position of the pedal is maintained a generally uniform distance from the floor of the vehicle throughout the adjustment range, as previously described.

Figure 10:
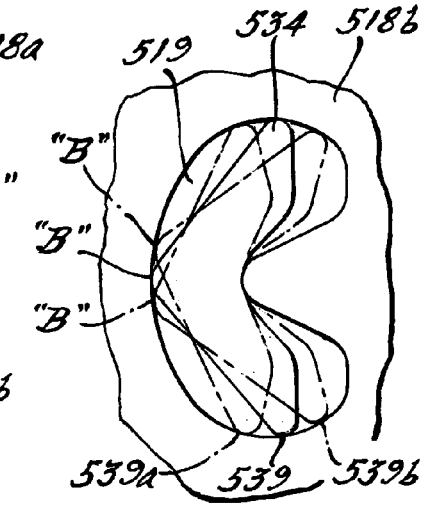
FIG. 10 is a sectional view illustrating the motion of the pivot pin within the guide channel, for the adjustable pedal assembly of FIG. 8, according to the present invention.
Figure 11:
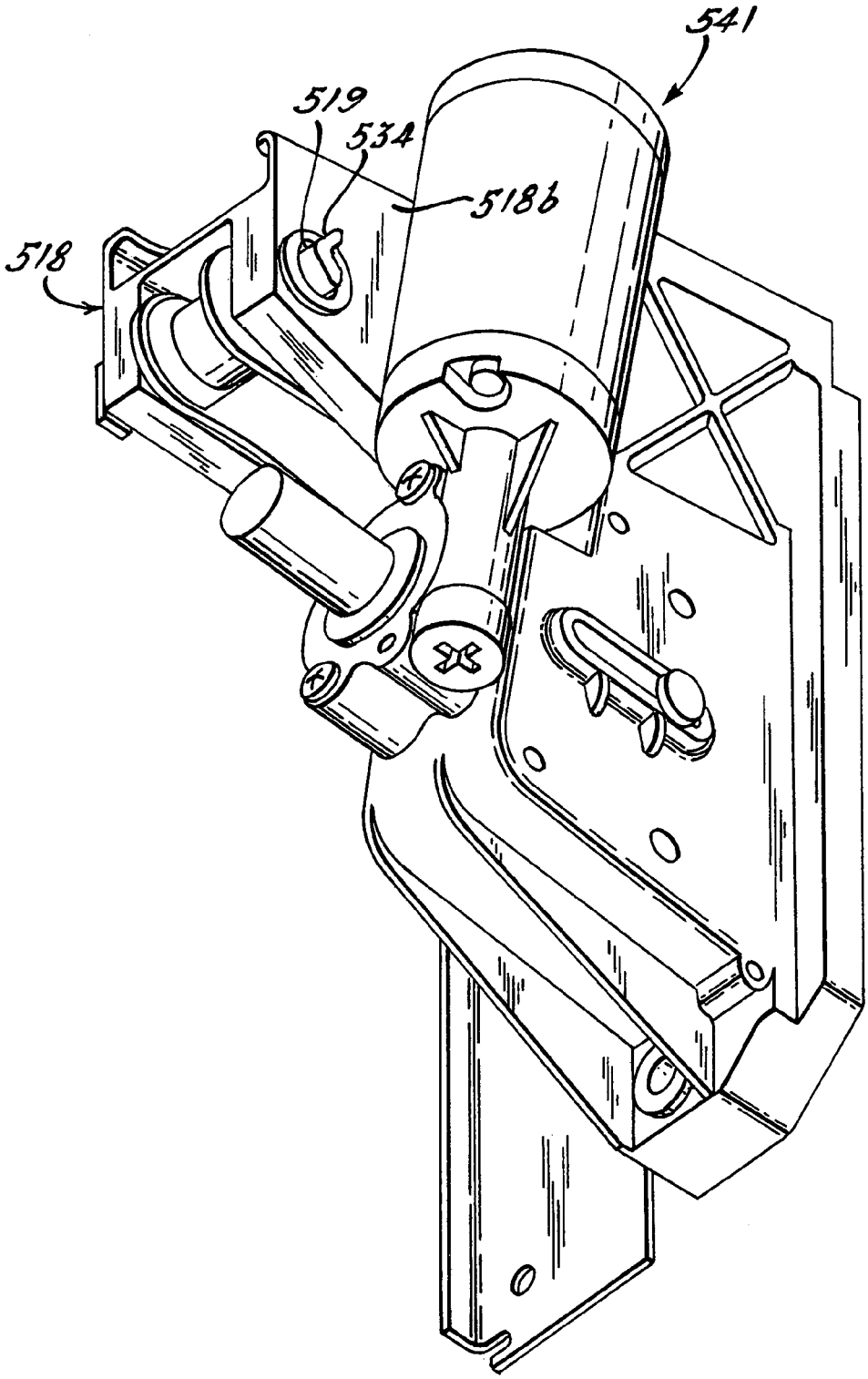
FIG. 11 is a perspective view of the swing plate for the adjustable pedal assembly of FIG. 8, according to the present invention.

Referring to FIGS. 8–11, another embodiment of an adjustable pedal assembly 510 is illustrated. It should be appreciated that like components have like reference numbers increased by 500. It should also be appreciated that the adjustable pedal assembly 510 may be an electronically controlled throttle assembly, as is known in the art, and include an electronic position sensing device 541 as shown in FIG. 11. An example of such a device includes a position sensor, a potentiometer, an inductive sensor, a hall sensor or the like.

The pedal assembly 510 includes a mounting bracket (not shown), as previously described, for attaching the pedal assembly 510 to a portion of the vehicle, such as the dash panel. The pedal assembly 510 also includes a swing plate 518 that is pivotally supported by the mounting bracket at a fixed first pivot point and corresponding pivot axis shown at "A". The swing plate 518 is attached to the mounting bracket using a conventionally known attaching means, such as a pin or the like.

Figure 8:
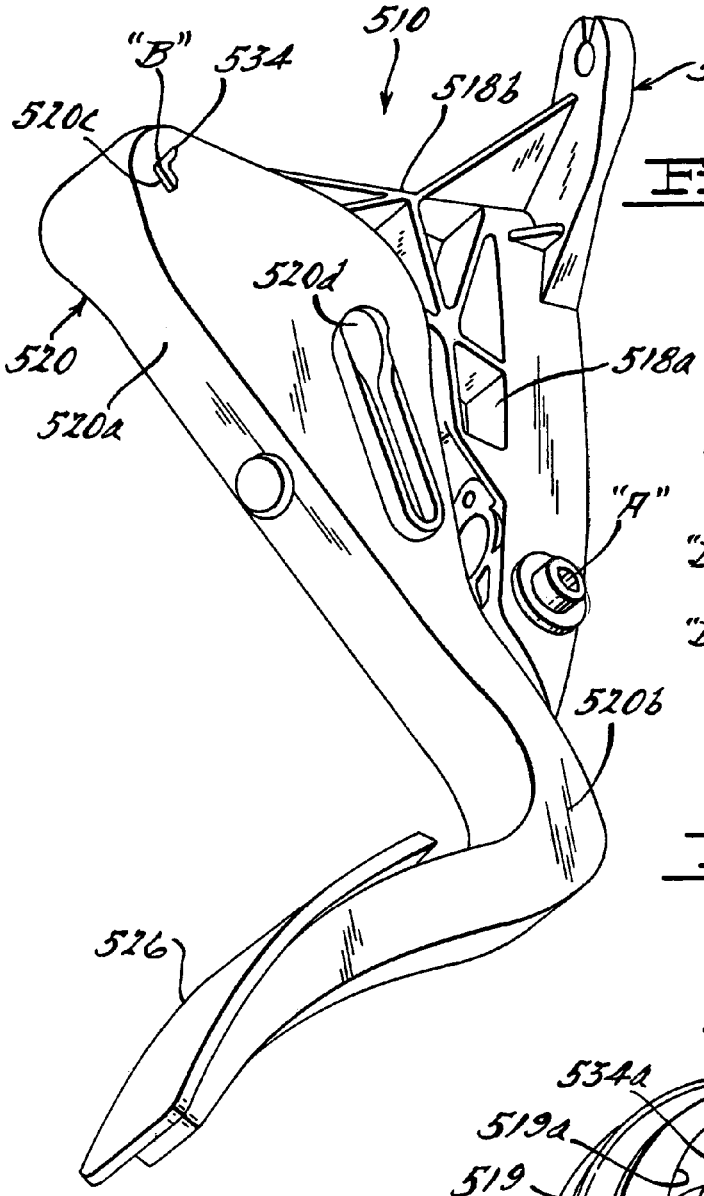
FIG. 8 is a perspective view of another alternative embodiment of an adjustable pedal assembly, according to the present invention.

The swing plate 518 includes a mounting face 518*a*, and a support arm 518*b* extending radially from an upper portion of the mounting face 518*a*. A pedal arm assembly 520 is pivotally attached to the support arm 518*b* in a manner to be described, for relative movement about a non-fixed pedal arm pivot point shown at "B". The pedal arm pivot axis "B" extends parallel to and outboard of the pivot axis "A". In FIG. 8, the pedal assembly is cable actuated, while in FIG. 11 the pedal assembly is an electronically controlled pedal, as is known in the art.

The support arm 518*b* includes a guide channel 519 positioned near an outer end of the support arm 518*b*. The support arm guide channel 519 is a longitudinally extending bore having a predetermined cross-sectional shape. In this example, the predetermined shape is generally a V-shape with rounded edges.

The pedal assembly also includes a pedal arm 520. In this example, the pedal arm is an elongated member having a front wall 520*a*, and side walls 520*b* extending from an edge of the front wall 520*a*. The upper end of each pedal arm sidewall 520*b* includes a longitudinally extending guide channel 520*c* having a predetermined shape for receiving a pin. For example, the pedal arm guide channel 520*c* generally has a V cross-sectional shape. A pedal pad 526 is attached to an other end of the pedal arm 520. In this example, the pedal pad 526 is fixedly attached to the pedal arm, as is known in the art. The side wall 520*b* of the pedal arm 520 includes an elongated slot 520*d*. An adjustment mechanism (not shown) is slidingly disposed within the slot 520*d*, for adjustment of the position of the pedal arm 520, as previously described.

Figure 9:
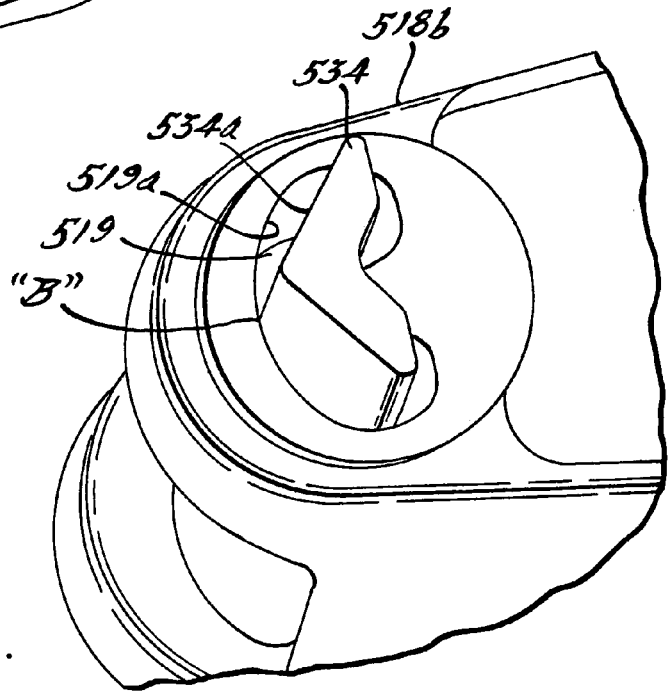
FIG. 9 is a side view of the variable pivot point for the adjustable pedal assembly of FIG. 8, according to the present invention.

The pedal arm 520 is connected to the swing plate 518 by a pivot pin 534 extending there through the support arm guide channel 519. As illustrated in FIG. 9, the pivot pin 534 has a predetermined cross-sectional shape corresponding to the cross-sectional shape of the pedal arm guide channel 520*c*. In the example, the pivot pin 534 generally has a "V" cross-sectional shape with defined edges. It should be appreciated that the pedal arm guide channel 520*c* has a similarly sized mating radius to the pivot pin 534, to provide for uniform movement of the pivot pin 534 and pedal arm 520. At the same time, the swing plate guide channel 519 has a different size mating radius than that of the corresponding pivot pin 534, to allow for eccentric movement of the pivot pin 534 within the swing plate guide channel 519.

In operation, as the pedal pad position is adjusted, the pivot pin 534 rotates about a non-fixed pivot point and corresponding pivot axis, shown at "B". The non-fixed pivot point "B" is defined by a point of contact between an outer surface 534*a* of the pivot pin 534 and an inner surface 519*a* of the guide channel 519. The position of the pivot point "B" varies along an arc 539 whose length is defined by the moving points of contact between the pin and the guide channel 519 as the pivot pin 534 rotates eccentrically about the guide channel 519, as shown in FIG. 10 between 539*a* and 539*b*.

The movement of the pivot pin 534 within the guide channel 519 is limited by the contact points between the pivot pin 534 and the guide channel 519, which in this example is four, although greater or fewer contact points are contemplated. The eccentric movement of the pivot pin 534 within the guide channel 519 constrains the rise of the pedal pad 526 as the pedal pad position is adjusted relative to the driver of the vehicle, so that the travel is substantially linear.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

The invention claimed is:

1. An adjustable pedal assembly for a vehicle comprising:

a mounting bracket adapted for mounting to a vehicle, wherein the mounting bracket includes a mounting face and a pair of opposed upper arms extending radially from an upper edge of the mounting face;

a first lever arm supported between said pair of mounting bracket upper arms at a first pivot point that is fixed during pedal adjustment;

a swing plate pivotally supported by said first lever arm at a second pivot point that is non-fixed during pedal adjustment and that is located radially outboard from said first fixed pivot point, wherein said swing plate includes a mounting face, a pair of upper arms extending radially from an upper edge of said mounting face, a lower arm extending vertically from an outer end of said swing plate upper arms and a pedal support arm extending outwardly from a lower edge of said mounting face that are integrally formed as one member;

a second lever arm, wherein one end of said second lever arm is pivotally attached to said swing plate lower arm at a third pivot point that is non-fixed during pedal adjustment and another end of said second lever arm is pivotally attached to said mounting bracket at a fourth pivot point that is fixed during pedal adjustment;

a pedal arm operatively attached to said swing plate at an upper end of said pedal arm;

a pedal pad operatively attached to said pedal arm at a lower end; and an adjustment means operatively connected to said pedal support arm for adjusting the position of said pedal pad along a predetermined path between a non-adjusted position and a fully adjusted position, wherein said first lever arm pivots about said fixed pivot point, said swing plate pivots about said second non-fixed pivot point while the second lever arm pivots about said third non-fixed pivot point and said fourth fixed pivot point, to constrain the travel of the pedal pad travels along the predetermined path.

2. An adjustable pedal assembly as set forth in claim 1 further comprising a first pivot axis extending longitudinally between said mounting bracket upper arms.

3. An adjustable pedal assembly as set forth in claim 1 wherein said first lever arm is a disc-shaped member with a radially extending pivot pin for pivotally supporting said first lever arm therebetween said mounting bracket upper arms.

4. An adjustable pedal assembly as set forth in claim 1 wherein said swing plate pivots about a second pivot axis that extends longitudinally between said mounting bracket upper arms at said second non-fixed pivot point.

5. An adjustable pedal assembly a set forth in claim 1 wherein said second non-fixed pivot point is located at an outer end of said mounting bracket upper arm, and radially outboard from the first fixed pivot point.

6. An adjustable pedal assembly as set forth in claim 1 wherein said second lever arm is a generally planar member.

7. An adjustable pedal assembly as set forth in claim 1 wherein an angle formed between said swing plate lower arm and said second lever arm decreases between a non-adjusted pedal position and a fully adjusted pedal position.

8. An adjustable pedal assembly as set forth in claim 1 wherein said adjustment means is a screw drive mechanism having a screw rod slidingly disposed in a guide slot in the swing plate pedal support arm.

9. An adjustable pedal assembly as set forth in claim 8 wherein said guide slot is a longitudinally extending slot having a predetermined shape.

10. An adjustable pedal assembly as set forth in claim 1 wherein said predetermined path of said pedal between a non-adjusted position and a fully adjusted position is substantially linear.

11. An adjustable pedal assembly as set forth in claim 1 wherein said second non-fixed pivot point is positioned radially outboard and below a horizontal line extending through said first fixed pivot point.

12. An adjustable pedal assembly as set forth in claim 1 wherein said first lever arm is a planar member having a generally rectangular shape, and one end of said first lever arm is pivotally mounted to the mounting bracket at said first fixed pivot point and an other end of said first lever arm is pivotally connected to said swing plate at said second non-fixed pivot point.

13. An adjustable pedal assembly as set forth in claim 1 wherein said first lever arm is a disc-shaped member having an arcuate slot disposed radially outwardly from the center of said first lever arm, and said first lever arm is pivotally mounted to said mounting bracket at said first fixed pivot point and said swing plate is slidably attached to said first lever arm at said second non-fixed pivot point.

14. An adjustable pedal assembly as set forth in claim 1 further comprising:

a guide housing having a gear sector with a plurality of gear teeth formed in said mounting bracket upper arms and said gear sector pivots about said first fixed pivot point which is positioned rearwardly of said gear teeth;

wherein said mounting bracket upper arm includes an arcuate slot having a radius of curvature centered on said first fixed pivot point, and said swing plate is slidingly support within the arcuate slot; and a gear sector integrally formed in an upper edge of said swing plate, which operatively cooperates with said swing plate gear sector; and a pin extending through the slots in the guide housing and a through bore in a top portion of the swing plate for pivotally attaching said swing plate to said mounting bracket so that said swing plate pivots at a second non-fixed pivot point, such that the pin is guided through an arcuate path formed by the slot in said guide housing of said upper arm to engage said gear sectors as said swing plate is pivoted about said second non-fixed pivot point, such that said swing plate moves downwardly and rearwardly within the slot in said guide housing upper arm.

15. An adjustable pedal assembly for a vehicle comprising:

a mounting bracket adapted for mounting to a vehicle, wherein the mounting bracket includes a mounting face and a pair of opposed upper arms extending radially from an upper edge of said mounting face;

a first lever arm supported between said pair of mounting bracket upper arms at a first pivot point that is fixed during pedal adjustment along a first pivot axis extending longitudinally between said mounting bracket upper arms;

a swing plate pivotally supported by said first lever arm at a second pivot point that is non-fixed during pedal adjustment and that is located radially outboard from said first fixed pivot point and along a second pivot axis extending longitudinally between said mounting bracket upper arms, wherein said swing plate includes a mounting face, a pair of upper arms extending radially from an upper edge of said mounting face, a lower arm extending vertically from an outer end of said swing plate upper arms and a pedal support arm extending outwardly from a lower edge of said mounting face that are integrally formed as one member;

a second lever arm, wherein one end of said second lever arm is pivotally attached to said swing plate lower arm at a third pivot point that is non-fixed during pedal adjustment and another end of said second lever arm is pivotally attached to said mounting bracket at a fourth pivot point that is fixed during pedal adjustment;

a pedal arm operatively attached to said swing plate at an upper end of said pedal arm;

a pedal pad operatively attached to said pedal arm at a lower end; and an adjustment means operatively connected to said pedal support arm for adjusting the position of said pedal pad along a predetermined path between a non-adjusted position and a fully adjusted position, wherein said first lever arm pivots about said fixed pivot axis, said swing plate pivots about said second non-fixed pivot point while and the second lever arm pivots about said third non-fixed pivot point and said fourth fixed pivot point, to constrain the travel of said pedal pad along the predetermined path that is substantially linear.

16. An adjustable pedal assembly as set forth in claim 15 wherein said first lever arm is a disc-shaped member with a radially extending pivot pin for pivotally supporting said first lever arm therebetween said mounting bracket upper arms.

17. An adjustable pedal assembly as set forth in claim 15 wherein said second non-fixed pivot point is located at an outer end of said mounting bracket upper arm, and radially outboard from the first fixed pivot point.

18. An adjustable pedal assembly as set forth in claim 15 wherein said second lever arm is a generally planar member.

19. An adjustable pedal assembly as set forth in claim 15 wherein an angle formed between said swing plate lower arm and said second lever arm decreases between a non-adjusted pedal position and a fully adjusted pedal position.

20. An adjustable pedal assembly as set forth in claim 15 wherein said adjustment means is a screw drive mechanism having a screw rod slidingly disposed in a guide slot in the swing plate pedal support arm.

21. An adjustable pedal assembly as set forth in claim 15 wherein said guide slot is a longitudinally extending slot having a predetermined shape.

22. An adjustable pedal assembly as set forth in claim 15 wherein said second non-fixed pivot point is positioned radially outboard and below a horizontal line extending through said first fixed pivot point.

23. An adjustable pedal assembly as set forth in claim 15 wherein said first lever arm is a planar member having a generally rectangular shape, and one end of said first lever arm is pivotally mounted to the mounting bracket at said first fixed pivot point and an other end of said first lever arm is pivotally connected to said swing plate at said second non-fixed pivot point.

24. An adjustable pedal assembly as set forth in claim 15 wherein said first lever arm is a disc-shaped member having an arcuate slot disposed radially outwardly from the center of said first lever arm, and said first lever arm is pivotally mounted to said mounting bracket at said first fixed pivot point and said swing plate is slidably attached to said first lever arm at said second non-fixed pivot point.

25. An adjustable pedal assembly as set forth in claim 15 further comprising:

a guide housing having a gear sector with a plurality of gear teeth formed in said mounting bracket upper arms and said gear sector pivots about said first fixed pivot point which is positioned rearwardly of said gear teeth;

wherein said mounting bracket upper arm includes an arcuate slot having a radius of curvature centered on said first fixed pivot point, and said swing plate is slidingly support within the arcuate slot; and a gear sector integrally formed in an upper edge of said swing plate, which operatively cooperates with said swing plate gear sector; and a pin extending through the slots in the guide housing and a through bore in a top portion of the swing plate for pivotally attaching said swing plate to said mounting bracket so that said swing plate pivots at a second non-fixed pivot point, such that the pin is guided through an arcuate path formed by the slot in said guide housing of said upper arm to engage said gear sectors as said swing plate is pivoted about said second non-fixed pivot point, such that said swing plate moves downwardly and rearwardly within the slot in said guide housing upper arm.

* * * * *

UNITED STATES PATENT AND TRADEMARK OFFICE

CERTIFICATE OF CORRECTION

PATENT NO. : 7,146,876 B2
APPLICATION NO. : 10/608484
DATED : December 12, 2006
INVENTOR(S) : Larry Willemsen It is certified that error appears in the above-identified patent and that said Letters Patent is hereby corrected as shown below:

Title page (*) Notice, in the patent term adjustment, replace “434” with --440--

Column 10, line 19, replace “assembly a” with --assembly as--

Column 10, line 67, replace “support” with --supported--

Column 11, line 54, after “while” delete “and”

Column 12, line 45, replace “support” with --supported--

Signed and Sealed this

Tenth Day of April, 2007

JON W. DUDAS
*Director of the United States Patent and Trademark Office*